US005737805A

United States Patent [19]

Xiao

[11] Patent Number: 5,737,805

[45] Date of Patent: Apr. 14, 1998

[54] SELF RISING COVER ASSEMBLY FOR MACHINE HOUSING

[75] Inventor: Ming Xiao, Terryville, Conn.

[73] Assignee: Pitney Bowes Inc., Stamford, Conn.

[21] Appl. No.: 571,663

[22] Filed: Dec. 13, 1995

[51] Int. Cl.[6] ..... E05D 15/30

[52] U.S. Cl. ..... 16/345; 220/335; 16/80

[58] Field of Search ..... 16/80, 82, 85, 16/371, 374, 343, 344, 334, 345; 220/264, 263, 335; 312/319.2, 319.1, 319.3, 327, 328, 319.4

[56] References Cited

U.S. PATENT DOCUMENTS

| | | | |
|---|---|---|---|
| 736,714 | 10/1903 | Gendron | 220/335 |
| 823,372 | 6/1906 | Steven et al. | 16/80 |
| 4,124,296 | 11/1978 | Kishi et al. | 355/75 |
| 5,240,319 | 8/1993 | Koga | 312/319.2 |
| 5,301,469 | 4/1994 | Lyons | 49/386 |

FOREIGN PATENT DOCUMENTS

| | | | |
|---|---|---|---|
| 561568 | 10/1923 | France | 312/319.2 |
| 2338971 | 5/1979 | Germany | 16/374 |

*Primary Examiner*—Chuck Mah
*Assistant Examiner*—Mark Williams
*Attorney, Agent, or Firm*—Robert H. Whisker; Melvin J. Scolnick; Robert Meyer

[57] ABSTRACT

Disclosed is a self rising cover assembly for use on a machine housing which includes a frame and a plurality of panels connected to the frame to define the machine housing. The cover assembly includes a flat body member which is pivotally connected to a portion of the frame to pivot from a closed horizontal position to an open nearly vertical position to provide operator access to the interior of the machine housing. A spring loaded actuator is interconnected between the body member and the frame which exerts sufficient upward torque on the body member to overcome the downward torque on the body member from the force of gravity to urge the body member upwardly after it has been manually lifted through a relatively short distance, after which the actuator moves the body member to the fully open position. The amount of torque exerted on the body member by the actuator to ensure that it becomes self rising at the desired point in its upward movement and that it remains in the open position until it is manually closed.

5 Claims, 4 Drawing Sheets

66
68
70
62
100
60
72
86
100
86
88
74
88
76
80
78
94
52
64
96
84
14
76
80
74
90
78
24
82
34
94
96
84
82
84
84
90
30
32
32
50
24
46
48
22
32
44
42
36
40
34
50
34
38
34

SELF RISING COVER ASSEMBLY FOR MACHINE HOUSING

BACKGROUND OF THE INVENTION

The present invention relates generally to the field of movable covers for machine housings, and more particularly to a cover assembly for a machine housing which is self rising over a major portion of its upward movement and which normally maintains an open position until manually closed.

The self rising cover assembly of the present invention is intended for use on a relatively large console type inserting machine. The inserting machine has two principal modules, a computer/printer module and an envelope printing and inserting module. The computer/printer module includes a central processing unit (CPR) which can be suitably accessed either from an onboard input device or from a remote computer terminal, and a laser printer under the control of the CPR to print any desired text on sheets of paper. The CPR and the laser printer are enclosed within a housing which includes front, rear and side panels and a top cover all suitably connected to a frame, and the top cover can be opened to provide access to the printer.

The inserting machine module is also enclosed within a housing which includes front, rear and side panels and a top cover all suitably connected to a frame, the front panel being a hinged door that opens to provide access to the inserting machine. The inserting machine is arranged such that sheets of paper exiting from the computer/printer module are fed directly into a sheet folding component of the inserting machine, from which they are inserted into envelopes which are fed from a storage position to an inserting position.

The entire inserting machine is approximately 8 feet long and 4 feet high, with the result that an operator of relatively short stature might encounter difficulty raising the housing cover of the computer/printer module. Typically, the CPR rests on the floor of the computer/printer module, and the laser printer rests on a shelf positioned over the CPR. Since access to the CPR is not normally required by an operator, the front panel of the housing is removably secured to the frame for service but is not normally removed by an operator. However, the printer must be accessible to an operator for the purposes of both routine service and maintenance, such as periodic replacement of toner material and to clear paper jams which may occur from time to time. The construction of the printer is such that virtually all parts and components of the printer that require operator service and maintenance procedures are accessible from the top of the printer by opening appropriate panels and/or covers, with the result that it is essential that the top of the printer be accessible to an operator through the top of the housing of the printer module.

Prior attempts to provide self rising covers for housings for various types of machines have been made with varying degrees of success, but for the most part they have not achieved the degree of advantageous features provided by the present invention. In some cases, the structure for causing the covers to be self rising has been relatively complicated and therefore expensive to manufacture, and often results in undesirable maintenance problems. In other cases, the mechanism causes the cover to rise from a lower most position, thereby requiring some form of latch mechanism to maintain the cover in a closed position during normal use of the machine or apparatus within the housing. In still other cases, the cover is self rising during a first portion of movement between the closed and open positions, but must be manually opened during a second portion of movement when it is more difficult to raise the cover.

Thus, there is a need for a self rising cover for machine housing which is very simple in construction and inexpensive to manufacture and maintain, which remains in either the closed or open positions without the need for complicated latch mechanisms and which is self rising to a fully open position after a relatively small amount of manual upward movement so that the effort required by an operator to raise the cover to the fully open position is minimal.

SUMMARY OF THE INVENTION

The present invention at least obviates if not entirely eliminates the disadvantages of prior art cover assemblies, and also provides a self rising cover assembly that meets the above described needs of the operators of machines of the type under consideration.

In its broader aspects the invention comprises a self rising cover assembly for use on a machine housing which includes a frame and a plurality of panels connected to the frame to define the machine housing. In this environment, the self rising cover assembly comprises a generally flat body member, hinge means mounted on an edge portion of the body member and a first portion of the frame for connecting the body member to the first portion of the frame for pivotal movement between a substantially horizontal closed position and a substantially vertical open position. An actuating means is interconnected between the body member and a second portion of the frame that is adjacent to the first portion thereof for exerting an upward torque on the body member which is of sufficient magnitude to overcome the downward torque from the force of gravity acting on the body member to move the body member upwardly relative to the frame. There is means operatively interconnected between the body member and the actuating means for causing the actuating means to exert the upward torque on the body member only during a major portion of the movement of the body member between the closed and open positions, commencing at an intermediate position closely adjacent to the closed position and terminating at the open position, with the result that after an operator manually raises the body member from the closed position to the intermediate position, the actuating means raises the body member from the intermediate position to the open position without further assistance from the operator.

In some of its more specific aspects, the actuating means comprises an arm having one end thereof pivotally connected to the second portion of the frame and extending away from the hinge means along the lower surface of the body member to a free end which is adapted to bear against the underside of the body member, and resilient means interconnected between the one end of the arm and the second portion of the frame for pivotally urging the arm upwardly about the one end to cause the other end thereof to move the body member through the major portion of the upward pivotal movement. The resilient means comprises a torsion spring interconnected between the second portion of the frame and the one end of the arm for urging the arm upwardly.

The means operatively interconnected between the body member and the actuating means for causing the actuating means to exert the upward torque on the body member only during a major portion of the movement of the body member comprises cam means secured to the lower surface of the body member, the cam means defining a cam surface which causes the actuating means to exert the upward torque on the body member during movement thereof from the closed position to the intermediate position which is insufficient to overcome the downward torque from the force of gravity on the body member, but which is sufficient to overcome the downward torque on the body member after the body member is manually moved from the closed position to the intermediate position to move the body member from the intermediate position to the open position. The arm includes a cam follower mounted at the free end thereof which moves along the cam surface during the upward movement of the body member from the closed position to the open position.

The cam surface comprises a first portion that commences at the lower surface of the body member and extends outwardly therefrom in a direction almost perpendicular to the lower surface of the body member, a second portion that defines a reverse curvature which extends from the first portion toward the edge of the body member that is connected to the first portion of the frame and inwardly toward the lower surface of the body member, and a third portion which defines a generally U-shaped recess at the end of the cam surface closest to the edge of the body member which captures the cam follower to prevent further upward movement of the body member when the cam follower means enters the recess.

Having briefly described the general nature of the present invention, it is a principal object thereof to provide an improved self rising cover assembly for a business machine which has features of novelty that avoid the disadvantages of prior art cover assemblies and provide advantages not heretofore achieved.

Another object of the present invention to provide a self rising cover assembly which normally maintains both closed and open positions with the need for complex mechanical latching mechanisms which might impede immediate response to manual movement of the cover in either an opening or closing direction.

Still another object of the present invention to provide a self rising cover assembly in which a cover member has sufficient weight when in a horizontal closed position to remain in that position despite an upward force imposed thereon, but which becomes self rising after a very small amount of manual upward movement.

A still further object of the present invention is to provide an improved self rising cover assembly which is very simple in construction, inexpensive to manufacture and requires virtually no maintenance.

These and other objects, advantages and novel features of the present invention will become more apparent from an understanding of the following detailed description of a presently preferred embodiment of the invention when considered in conjunction with the accompanying drawings.

DETAILED DESCRIPTION OF THE INVENTION

Figure 1:
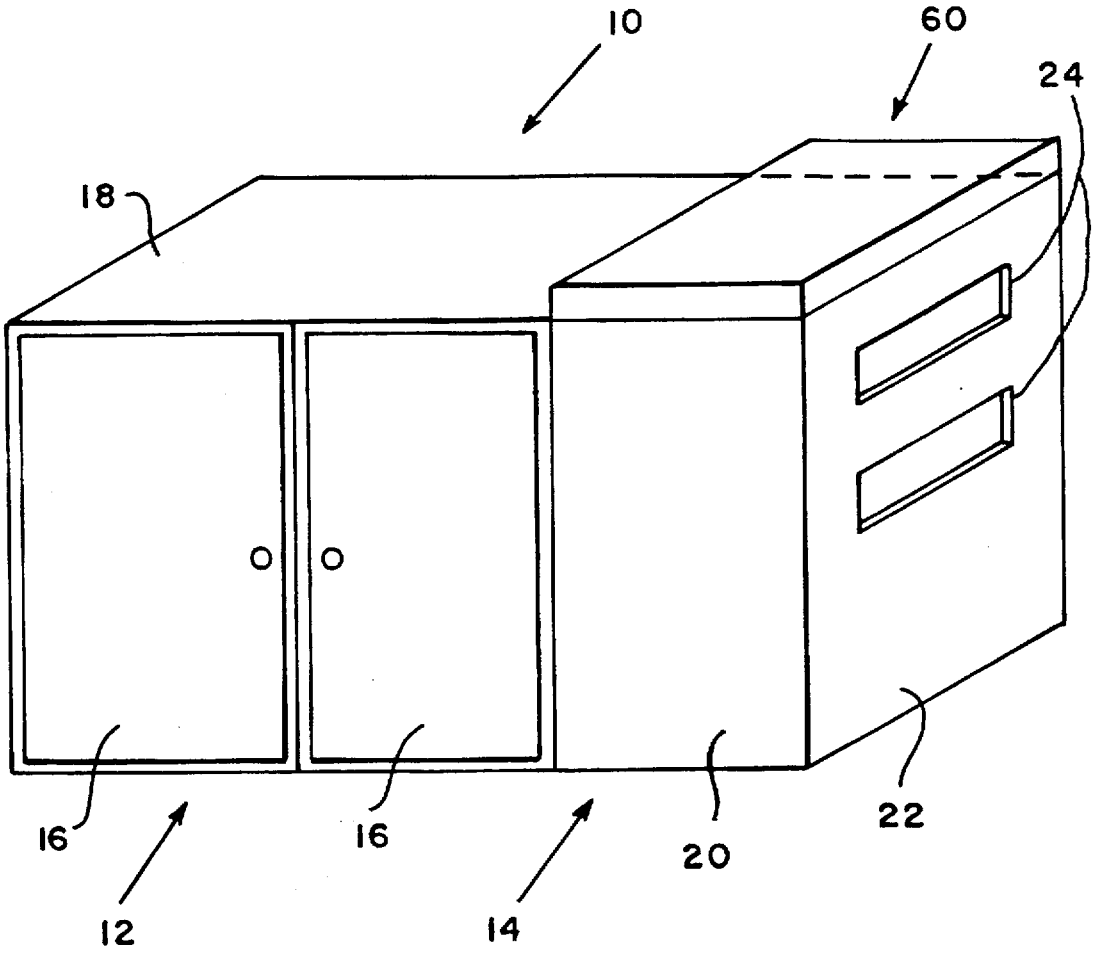
FIG. 1 is a perspective view of a typical envelope inserting machine on which includes the self rising cover assembly of the present invention.

Referring now to the drawings, and particularly to FIG. 1 thereof, there is seen an envelope inserting machine, indicated generally by the reference numeral 10, which consists of two major components, an envelope inserting component, indicated generally by the reference numeral 12, and a computer printer component, indicated generally by the reference numeral 14. The machine 10 includes a suitable frame (only essential portions of which are described below) and a plurality of panels which form either doors or walls, such as the front doors 16 and top wall 18 of the envelope inserting component 12, and the front and side walls 20 and 22 of the computer printer component 14. These panels (and others not visible in the figure) enclose the various mechanisms of the envelope inserting and computer printing components and either can be opened or are removably secured to the frame to permit access to these mechanisms for routine service or occasional maintenance and repair, as the case may be. The side wall 22 is provided with a pair of openings 24 through which paper cassettes can be inserted for attachment to the computer printer (not shown) suitably mounted in the component 14 as further described below. Since the envelope inserting component 12 forms no part of the present invention, no further description thereof is deemed necessary.

Figure 2:
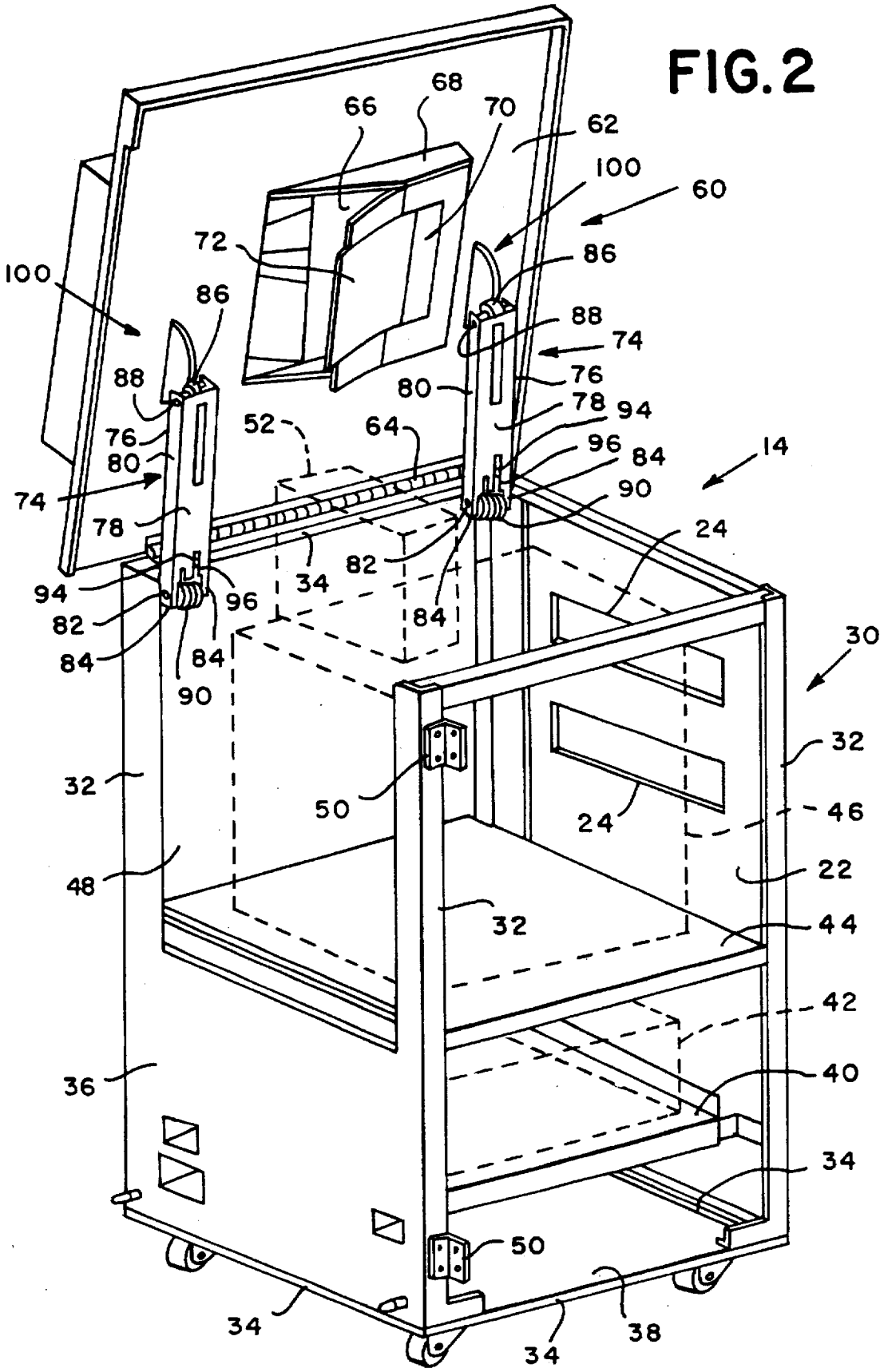
FIG. 2 is a perspective view of the computer and printer module of the inserting machine shown in FIG. 1, with the self rising cover assembly of the present invention shown in the fully open position.

Referring now to FIG. 2, the computer printer component is shown separately from the rest of the machine 10, and is seen to comprise a suitable frame, indicated generally by the reference numeral 30, and which is part of the frame mentioned above for the entire machine 10. The frame 30 comprises a plurality of upright members 32 located in the corners of the component 14, and horizontal members 34 located at the top and bottom of the component 14. A wall 36 forms a partial partition between the computer printer component 14 and the envelope inserting component 12, and the wall panel 22 is also shown in place on the far end of the frame 30.

The computer printer component 14 further includes a floor 38 supported by the lower horizontal frame members 34 which may support part of the computer equipment if necessary, or it may be utilized for storage of consumable supplies, such as toner and paper for the printer. A lower shelf 40 is supported by the upright frame members 32 which supports a computer 42 (shown in phantom lines), and another shelf 44 is supported by the upright frame members 32 and supports a computer printer 46 (shown in phantom lines). The opening 48 above the wall 36 provides access for directly feeding successive sheets of paper from the computer printer 46 to an infeed mechanism of the envelope inserting component 12, which does not require further description for an understanding of the present invention. Suitable door hinges 50 mounted on one of the upright frame members 34 support the door 20 (shown in FIG. 1) to provide front access for maintenance or service of the computer 42 and the printer 46, as well as for storage and retrieval of supplies.

The nature and construction of the computer printer 46 is such that direct and relatively frequent access to the top of the printer must be provided. The printer 46, which preferably is a laser printer, has a paper transport device which feeds sheets of copy paper through the printer 46 for printing thereon under the control of the computer 42. There are also other components in the printer 46, such as the laser imaging system and the toner fixing system through which the copy paper must be fed. Thus, it is essential for an operator of the machine 10 to have access to the top of the printer 46 which is where most of the aforementioned paper transport devices and other components are located. The printer 46 typically has one or more transport components, which may also include a suitable cover which must be raised to provide access to the transport components, all of which are indicated in phantom lines by the reference numeral 52, which are mounted in the printer for pivotal movement from a closed position within the printer to an open position as indicated by the numeral 52 for the purpose of providing the operator with adequate access to the interior of the printer 46 for various routine operator service and maintenance activities, such as clearing paper jams, replacing toner, cleaning, etc. It should be apparent from the discussion thus far that it is necessary to have sufficient vertical clearance above the printer 46 in order to raise the transport component(s) 52 to provide the necessary operator access to the upper portion of the interior of the printer 46.

As seen in FIG. 1, the computer printer component 14 is provided with a cover assembly, indicated generally by the reference numeral 60, which normally encloses the top of the component 14 and which must be opened to provide the aforementioned operator access to the computer printer 46. Referring back to FIG. 2, it will be seen that the cover assembly 60, shown in the fully open position, comprises a generally flat body member 62 which is typically rectangular. The body member 62 is connected to a suitable hinge 64 which in turn is connected to a first portion of the frame 30 at the upper rear horizontal frame member 34, thereby permitting the body member 62 to pivot between the closed position shown in FIG. 1 and the open position shown in FIG. 2. The body member 62 is provided with a generally centrally located opening 66 which is bounded on three sides by downwardly extending short walls 68 which are connected to a generally horizontal wall 70 which includes a downwardly curved portion 72. The opening 66 and the structure associated with it is for the purpose of returning printed sheets that are not intended to be fed on to the envelope inserting component 12 in the event that the printer 46 is being used as a stand alone printer for the computer 42, or if the operator wishes to review the content of printed sheets for accuracy or quality prior to their being inserted into envelopes.

The present invention is essentially the means by which the body member 62 is raised from the closed position to the open position and maintained in the open position until it is manually lowered. To this end, and referring to FIGS. 2, 3 and 4, it will be seen that the cover assembly 60 further includes at least one, and preferably a pair, of actuator assemblies, indicated generally by the reference numeral 74, which are interconnected between the body member 62 and the frame 30 for raising the cover assembly 60 as hereinafter described. Each actuator assembly 74 comprises an elongate arm 76 which, in the disclosed embodiment, is of channel shaped cross section having a lateral web 78 and side flanges 80, although other shapes may be used. One end of each arm 76 is pivotal connected to a second portion of the frame 30 at a location on the upper end of the side frame members 32 that is slightly spaced from the first portion of the frame 30 where the hinge 64 is connected by means of a pin 82 which passes through short extensions 84 of the side flanges 80. The other end of each arm 76 is provided with a cam follower 86 which is rotatably mounted on a pin 88 mounted between the ends of the flanges 80, the purpose of the cam followers 86 to be made clear hereinbelow.

Figure 3:
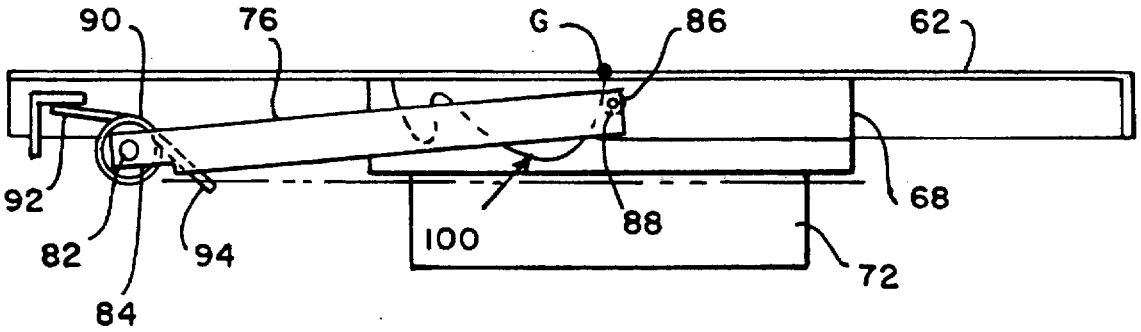
FIG. 3 is a side elevation of the cover assembly of the present invention shown in the closed position.
Figure 4:
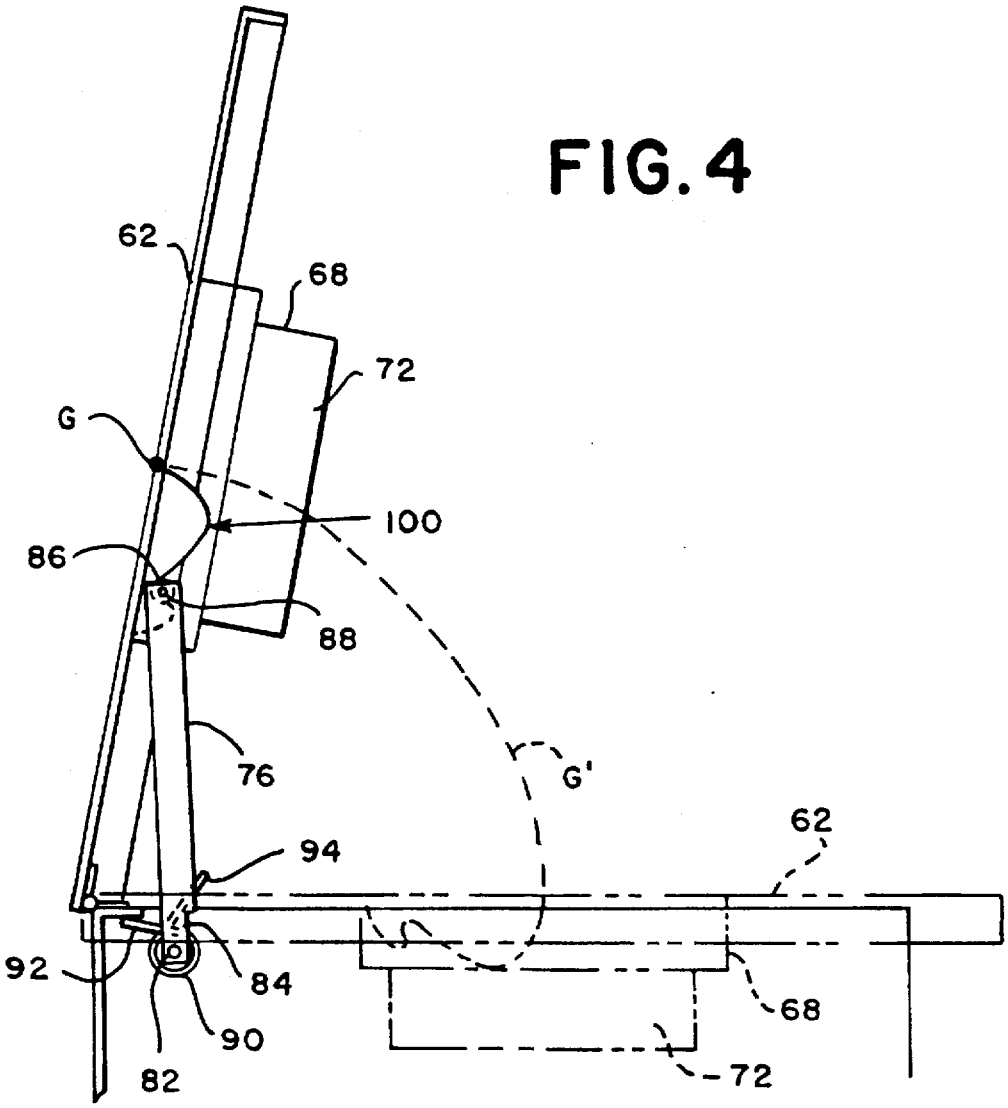
FIG. 4 is a view similar to FIG. 3 showing the cover assembly of the present invention in the open position.

The actuating assemblies 74 further include resilient means for causing the arms 76 to exert an upward force on the body member 62 to raise it from the closed horizontal position shown in FIGS. 1 and 3 to the open nearly vertical position shown in FIGS. 2 and 4. In the disclosed embodiment this takes the form of a pair of torsion springs 90, the coils of which are wrapped around the pins 82, each spring 90 having a constant spring force. A first tang 92 of each spring 90 is engaged underneath the horizontal flange of the horizontal frame member 34, and a second tang 94 protrudes through a slot 96 formed in the lower end of the lateral webs 78. The springs 90 are biased in such a direction that the tang 94 on each arm 76 exerts an upward force on the lower end of the lateral web 78 when the arm is in the horizontal position.

One of the features of the present invention is that the actuating assemblies 74 exert sufficient upward force on the body member 62 only during a major portion of the movement of the body member 62 between the closed and open positions, which major portion of the movement commences at an intermediate position that is closely adjacent to the closed horizontal position shown in FIG. 3, with the result that the cover assembly 60 is self rising only after it is manually moved to this intermediate position. Thus, the cover assembly 60 is provided with a pair of cams, indicated generally by the reference numeral 100, which are located on the lower surface of the body member 62 adjacent the free ends of the actuator arms 76. The cams 100 may be molded integrally with the body member 62 or they may be otherwise fabricated and attached to the lower surface of the body member 62.

Figure 5:
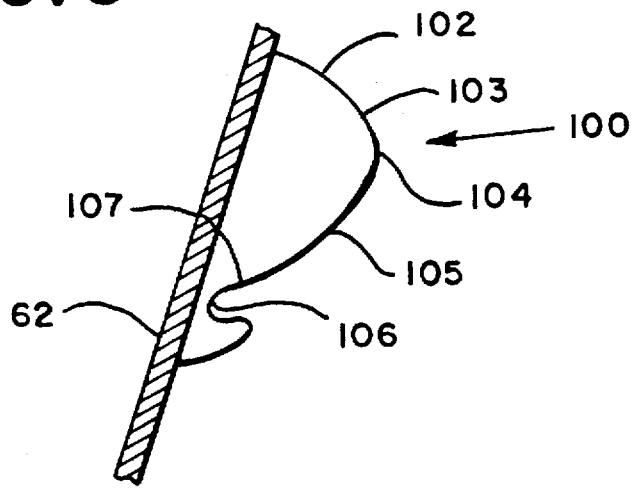
FIG. 5 is a fragmentary view drawn to an enlarged scale of the cams that control the variation in force that is required to raise and/or lower the cover assembly.

As best seen in FIG. 5, each cam 100 has a surface configuration having a first portion 102 which commences at the lower surface of the body member 62 and extends outwardly therefrom in a direction almost perpendicular to the lower surface, until it merges approximately at the location indicated by the reference numeral 103 with a second portion 104 follows a path of reverse curvature with respect to the first portion 102 and which terminates in a very slightly curved surface 105 that is directed back toward the lower surface of the body member 62, but at a substantial angle with respect thereto. A third portion 106 which merges with the second portion approximately at the location indicated by the reference numeral 107 and defines a generally U-shaped recess at the end of the surface 105 and adjacent to the lower surface of the body member 62 which is adapted to capture the cam follower 86 when the cover member 60 is in its uppermost position as shown in FIG. 4.

Figure 6:
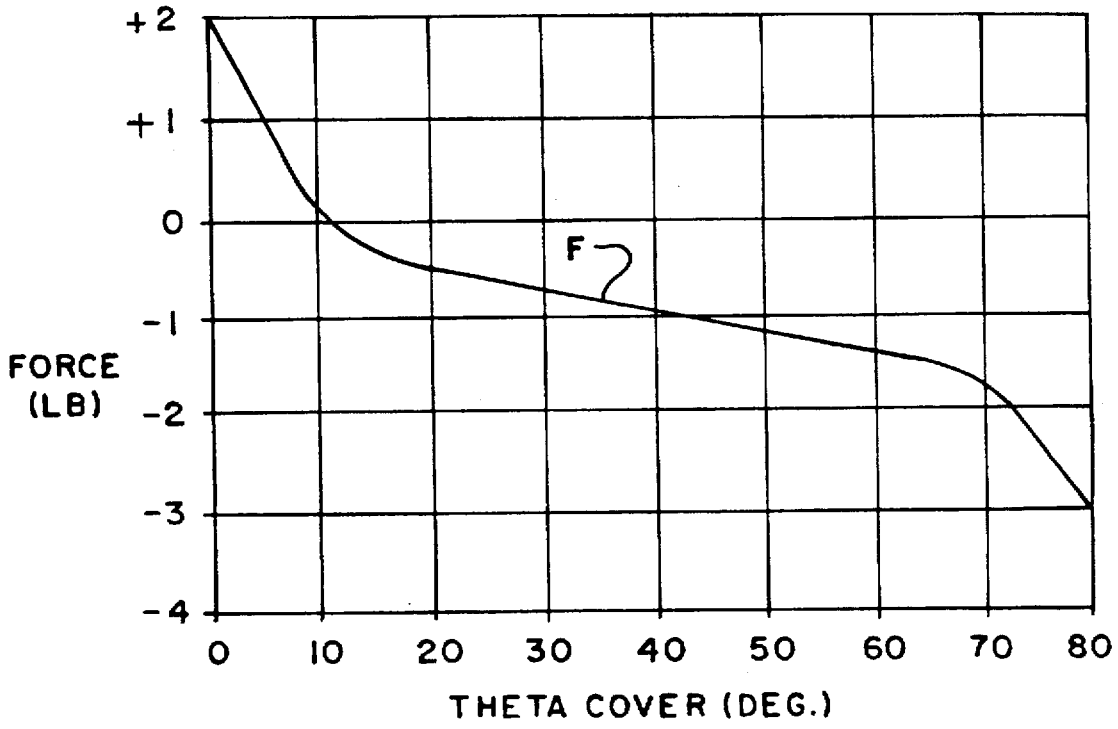
FIG. 6 is a graph showing the relative amount of force required by an operator to raise and/or lower the cover assembly.

From the foregoing description, and with additional reference to FIG. 6, the operation of the self rising cover assembly 60 will now be described. Commencing with the cover assembly in the closed horizontal position as shown in FIG. 3, it will be seen that the center of gravity G of the body member 62 is at a position approximately over the front to rear center line of the body member 62 as defined by the axis of the cam followers 86. At this time the cam followers 86 are pressing directly upwardly against the lower surface of the body member 62 under the action of the torsion springs 90, but with insufficient torque to overcome the downward torque from the force of gravity acting on the body member 62. This is illustrated in FIG. 6, which is a graph showing the approximate amount of external or operator force required to open and close the cover assembly 60, in which the X axis is the angle of elevation of the cover assembly 60 in 10° increments from the 0° position shown in FIG. 3 to the 80° position shown in FIG. 4, and the Y axis represents the pounds of force which the operator must exert to move the cover assembly 60 up and down. The force line F represents the amount of force required by the operator at any point between the FIG. 3 and FIG. 4 positions, being expressed as positive above the 0 line and negative below the 0 line for upward movement of the cover assembly 60. It will be apparent that during downward movement of the cover assembly 60 the force line is read from right to left and the positive and negative indications would be reversed.

Thus, to open the cover assembly 60, an operator must initially raise the body member 62 a predetermined distance which, as further explained below, is approximately 10° from horizontal. During this initial movement of the cover assembly 60, the actuator arms 76 remain virtually stationary because the movement of the cam followers 86 along the first portion 102 of the cams100 to approximately the juncture 103 counteracts the upward movement of the actuator arms 76 that would occur if the cams 100 were not present, thereby preventing the actuating arms 76 from rising. Thus, the upward torque from the torsion springs 90 also remains virtually constant during this 10° rise of the body member 62. As seen in FIG. 6, the force required by the operator is approximately 2 pounds to commence upward movement of the body member 62 which quickly drops to 0 pounds when the body member 62 reaches the 10° angle.

Also during this initial upward movement, the center of gravity G of the body member 62 moves toward a vertical projection of the pivot edge of the body member 62 at the hinge 64 along the arcuate dotted line G' seen in FIG. 4, thereby decreasing the horizontal distance between the pivot point of the body member 62 and the center of gravity G, with the result that the downward torque from the force of gravity on the body member 62 becomes less than it was with the body member 62 in the fully horizontal position of FIG. 3. However, since, as noted above, the actuator arms 76 remain virtually stationary, and therefore the upward torque from the torsion springs 90 remains virtually the same, during this initial 10° upward movement of the body member 62, the upward torque from the springs 90 becomes sufficient to overcome the downward torque on the slightly elevated body member 62. The body member 62 now commences further upward movement in response to the upward torque of the torsion springs 90, and this is indicated in FIG. 6 by the force line F showing that the upward force required by the operator has dropped to 0 pounds at about the 10° angle of elevation, and continues to decrease at about a constant rate until the body member 62 reaches approximately the 70° angle of elevation, thereby indicating that the cover assembly 60 is self rising during this portion of upward movement.

As the body member continues to move upwardly, the cam followers move along the second portion 104 of the cams 100, which includes the slightly curved portions 105, which allows the actuator arms 76 to rise at a more rapid rate than the body member 62, since the cam followers 86 are now moving back toward the lower surface of the body member 62 while it is also moving upwardly.

It should be noted that the precise shape of the cam surface portions 105 is designed such that, during the combined upward movement of the body member 62 and the actuator arms 76, the upward torque exerted by the springs 90 diminishes at a slightly slower rate than does the downward torque on the body member 62 from the force of gravity as the center of gravity G moves along the line G'. Thus, the degree of upward torque from the torsion springs 90 increases slightly relative to the downward torque on the body member 62, with the result that, as the body member 62 rises from about the 10° position to the 70° position, there is a slight increase in the angular velocity of the body member 62, although the overall movement between these two positions is fairly gradual.

This combined upward movement of the body member 62 and the actuator arms 76 continues until the body member 62 has reached approximately a 70° angle of elevation, at which point the cam followers 86 have reached the end of the cam surfaces 105 and are closely adjacent to the lower surface of the body member 62. At this point, the downward torque from the force of gravity on the body member 62 decreases rather abruptly during its final 10° rise, which is indicated in FIG. 6 by the rather abrupt negative force that would be required by an operator to move the body member 62 during this final portion of upward movement. The body member 62 therefore accelerates somewhat during this final portion of upward movement as the cam followers 86 move into the recesses 106, which thereby prevent further upward movement of the body member 62, which is now at approximately an 80° angle of elevation. At this point, there is sufficient upward torque still being exerted by the torsion springs 90 to ensure that the cam followers 86 remain in the recesses 106 and maintain the body member 62 in the fully open position.

Conversely, in closing the cover assembly 60, it will be apparent from the foregoing that the operator force and the relative degree of downward torque on the body member 62 from the force of gravity and the upward torque from the torsion springs 90 is the reverse of that described above. Thus., as seen in FIG. 6, and reading the force line from right to left, it will be seen that the operator must exert a downward force of 3 pounds on the body member 62 to commence downward movement thereof where the downward torque from the force of gravity is at a minimum, but which decreases rather sharply to less than 2 pounds at about the 70° elevation, at which point the force required by the operator for further downward movement diminishes gradually because the center of gravity of the body member 62 is now shifting toward the opposite edge along the arcuate line G', thereby increasing the force of gravity on the body member 62, while at the same time the downward movement of the actuator arms 76 are placing increased stress on the torsion springs 90 due to the downward movement of the actuator arms 76. This continues until the body member 62 is again at about the 10° angle where the center of gravity of the cover assembly 60 has shifted far enough so that the downward torque from the force of gravity acting on the cover assembly 60 equals the upward torque from the torsion springs 90. At this point, the cover assembly 60 is no longer self rising and no further downward force is required by the operator, and the torque from the force of gravity will move the cover assembly 60 through the remaining 10° of movement to the fully closed position.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. A self rising cover assembly for use on a machine housing which includes a frame and a plurality of panels connected to the frame to define the machine housing, said cover assembly comprising:

a) a general flat body member, b) hinge means mounted on an edge portion of said body member and a first portion of said frame for connecting said body member to said first portion of said frame for pivotal movement between a substantially horizontal closed position and a substantially vertical open position, c) actuating means interconnected between said body member and a second portion of said frame adjacent to said first portion for moving said body member upwardly relatively to said frame, said actuating means exerting an upward toque on said body member of insufficient magnitude to overcome the downward torque due to the force of gravity acting on said body member when said body member is in said closed position, and d) said body member including a cam secured to said lower surface of said body member, said cam defining a cam surface which causes said actuating means to remain substantially stationary while continuing to exert said upward torque on said body member during movement thereof from said closed position to an intermediate position, said downward torque due to the force of gravity on said body member becoming less than said upward torque after said body member is manually moved from said closed position to said intermediate position, and said cam surface causing said actuating means to continue to exert said upward torque on said body member after said body member is manually moved from said closed position to said intermediate position, whereby after an operator manually raises said body member from said closed position to said intermediate position, said actuating means raises said body member from said intermediate position to said open position without further assistance from the operator.

2. A self rising cover assembly as set forth in claim 7 wherein said actuating means comprises a) an arm having one end thereof pivotally connected to said second portion of said frame and extending away from said hinge means along the lower surface of said body member to a free end which is adapted to bear against underside of said body member, and b) resilient means interconnected between said one end of said arm and said arm and said second portion of said frame for urging said arm upwardly about said one end thereof to cause said free end thereof to move said body member through a major portion of said pivotal movement.

3. A self rising cover assembly as set forth in claim 2 wherein said resilient means comprises a torsion spring interconnected between said second portion of said frame and said one end of said arm for urging said arm upwardly.

4. A self rising cover assembly as set forth in claim 3 wherein said arm includes a cam follower mounted at said free end thereof which mves along said cam surface during said upward movement of said body member from said closed position to said open position.

5. A self rising cover assembly as set forth in claim 4 wherein said cam surface comprises:

A. a first portion that commences at said lower surfaces of said body member and extends outwardly therefrom in a direction almost perpendicular to said lower surface of said body member, B. a second portion that merges with said first portion and defines a reverse curvature which extends from said first portion toward said edge of said body member that is connected to said first portion of said frame and inwardly toward said lower surface of said body member, and C. a third portion which merges with said second portion and defines a generally U-shaped recess at the end of said cam surface closest to said edge of said body member which captures said cam follower to prevent further upward movement of said body member when said cam follower means enters said recess.

* * * * *